US007077356B2

(12) United States Patent
Hope

(10) Patent No.: US 7,077,356 B2
(45) Date of Patent: Jul. 18, 2006

(54) CORE CHUCK

(76) Inventor: Harry L. Hope, 57 Gear Rd., Rochester, NH (US) 03839

( * ) Notice: Subject to any disclaimer, the term of this patent is extended or adjusted under 35 U.S.C. 154(b) by 0 days.

(21) Appl. No.: 10/819,030

(22) Filed: Apr. 6, 2004

(65) Prior Publication Data

US 2004/0256518 A1 Dec. 23, 2004

Related U.S. Application Data

(60) Provisional application No. 60/479,875, filed on Jun. 19, 2003.

(51) Int. Cl.
*B65H 75/24* (2006.01)

(52) U.S. Cl. ..... 242/575.3; 242/575.4

(58) Field of Classification Search ..... 242/575.3, 242/575.4, 576.1
See application file for complete search history.

(56) References Cited

U.S. PATENT DOCUMENTS 566,368 A * 8/1896 Wuelfing ..... 242/575.3
3,695,561 A * 10/1972 Pitts ..... 242/571.6
3,792,868 A 2/1974 Flag ..... 279/2
3,963,250 A 6/1976 Flag ..... 279/2 R
3,993,317 A * 11/1976 Flagg ..... 279/2.19
4,193,633 A 3/1980 Potter ..... 279/2 R
4,339,094 A * 7/1982 Thievessen et al. ..... 242/571.7
5,490,640 A * 2/1996 Miller et al. ..... 242/571.6

* cited by examiner

*Primary Examiner*—Kathy Matecki
*Assistant Examiner*—Sang Kim
(74) *Attorney, Agent, or Firm*—Bourque & Associates, P.A.

(57) ABSTRACT

A core chuck includes "lock and key" or "key and keyhole" interfaces between the central cam and the mounting plate and the central cam and the end cap. The central cam includes central region having a multi-faceted camming surface adapted to expand and retract a plurality of jaws as is well known. Unlike known core chucks, the first end of the central core has a non-circular perimeter and the mounting plate includes a cavity sized and shaped to substantially correspond to the non-circular perimeter of the central and form a "lock and key" or "key and keyhole" arrangement. A plurality of fasteners secure the central cam to the mounting plate with their heads disposed proximate the second end region of the central cam. The end cap includes a second cavity sized and shaped to form a "lock and key" or "key and keyhole" arrangement with the heads of the fasteners.

20 Claims, 5 Drawing Sheets

CORE CHUCK

CROSS-REFERENCE TO RELATED APPLICATIONS

This application claims the benefit of U.S. Provisional Application No. 60/479,875, filed Jun. 19, 2003.

TECHNICAL FIELD

The present invention relates to core chucks and more particularly, relates to core chucks having an interface between a mounting plate and a central cam that transmits torque, bending and shear loads.

BACKGROUND INFORMATION

Core chucks 10, FIG. 1, for use in winding and/or unwinding rolls of material including but not limited to paper, plastic film and metal foil (not shown) are well known. Core chucks 10 typically include, in addition to other mechanical elements, a mounting plate 12 having a plurality of holes 14, keyway and/or other connecting features adapted for mounting to the rotating surface of the winding or unwinding machine, often but not necessarily known as a roll stand (not shown). The structure of torque activated core chucks also generally includes a central cam 16 having a multi-faceted surface 18 and an end cap 20. The mounting plate 12 often includes an inwardly, cylindrical opening (often termed a pilot hole) 24 disposed in the center of the mounting plate 12 which is adapted to receive the first end 22, often termed a pilot, of the central cam 16. The first end 22 of the central cam 16 is generally made cylindrical (typically using a lathe) such that the end 22 fits, with controlled clearance or interference, within the opening 24 in the mounting plate 12. This is done for geometric (centering) and/or load carrying reasons. The shape of the pilot engagement (round) tends to facilitate economical manufacturing such as by conventional or automated lathe turning and boring.

There are several problems with the known core chuck 10. For example, the torque and other forces generated during the rotation of a roll of material are transmitted through the central cam 16, and ultimately through the mounting plate 12 to the rotating surface of the roll stand or similar machine. As a result, a considerable amount of torque and other loads are transmitted through the interface between the first end 22 of the central cam 16 and the opening 24 in the mounting plate 12. Because the opening 24 and the end 22 are cylindrical, the torque generated during use is transmitted only by friction and by a plurality of mounting screws 23 that secure the central cam 16 to the mounting plate 12, potentially augmented by additional conventional fasteners such as cylindrical pins. The above described connection, based upon a cylindrical pilot, tends to have critical limits of torsional capacity, which, when exceeded, cause mechanical failure with associated repair costs, production downtime costs and potentially human injury.

Accordingly, what is needed is a core chuck having an improved interface between the mounting plate and the central cam. The interface should transmit the torque and shear stresses generated during operation by non-cylindrical engagement, such that the mounting screws and associated friction holding the central cam 16 to the mounting plate 12 are not subjected to all the torque and shear loads. Such non-cylindrical engagement, permitting the central cam to serve as an integral key, further permits the screw pattern to be replaced with a single, center screw.

SUMMARY

A core chuck, according to the present invention, includes a central cam, a mounting plate, and end cap. The central cam has a first end region, a second end region, and a central region disposed between the first and the second end region. The central region has a multi-faceted camming surface adapted to expand and retract a plurality of jaws as is well known in the art. The first end region includes a multi-faceted or non-circular perimeter. The end cap is adapted to be secured to the second end region of the central cam.

The mounting plate defines a first aperture or cavity sized and shaped to accept at least a portion of the first end region of the central cam. The interface between the first aperture/cavity and the multi-faceted/non-circular perimeter of the first end region of the central cam forms a "lock and key" or "key and keyhole" arrangement such that the perimeter of the first aperture/cavity substantially corresponds to the multi-faceted/non-circular perimeter of the central cam. In the preferred embodiment, the multi-faceted/non-circular perimeter of the first end region includes a shape substantially corresponding to the multi-faceted camming surface of the central region.

The end cap is preferably secured to the second end region of the central cam without a commercial pin. In the exemplary embodiment, the central cam is secured to the mounting plate with a plurality of longitudinally disposed apertures sized and shaped to accept a plurality of fasteners, each having a head disposed proximate the second end region of the central cam. The end cap preferably includes an interior end surface defining an aperture sized and shaped to engage at least a portion of the heads of the fasteners and form a "lock and key" or "key and keyhole" arrangement.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 2:
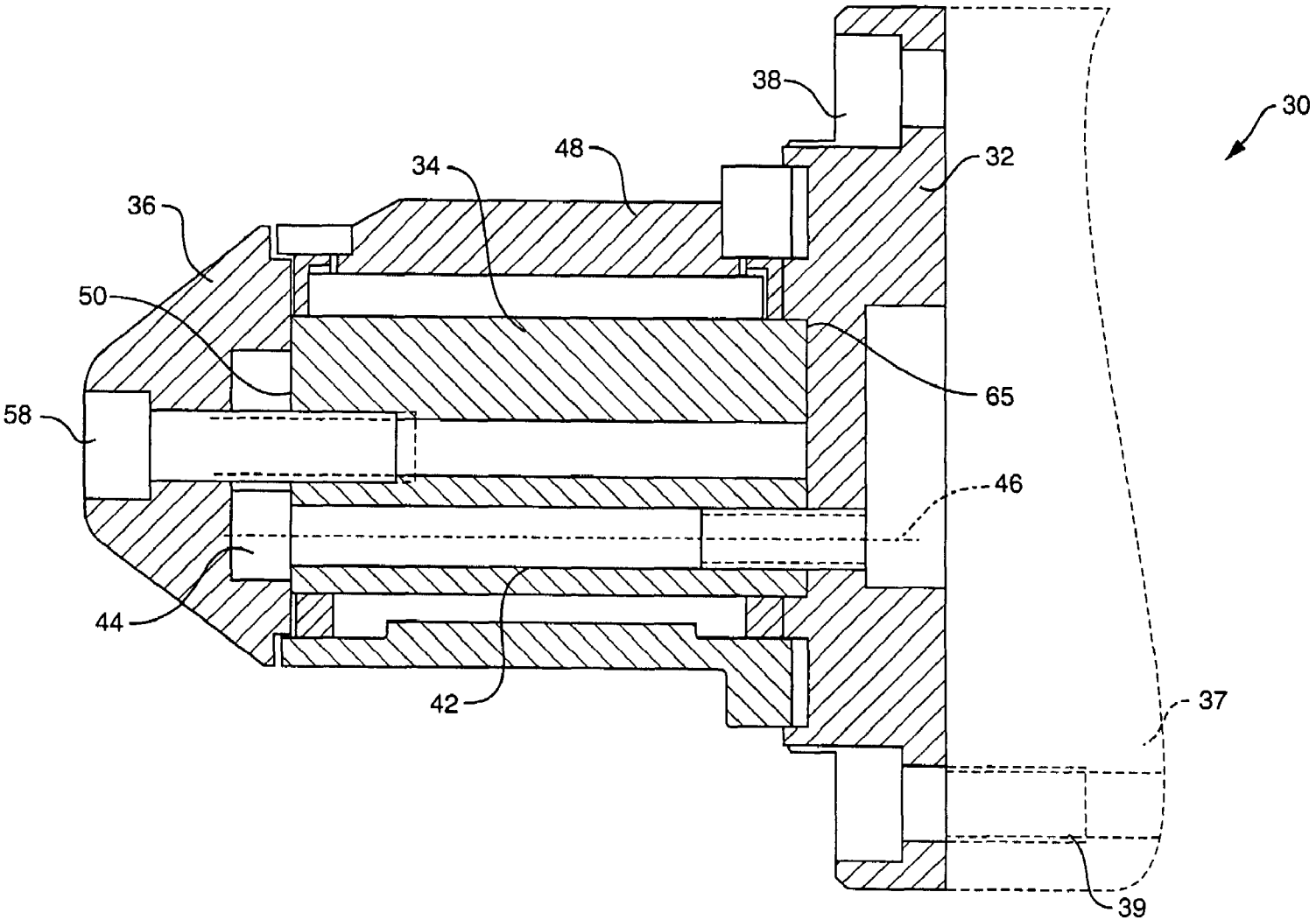
FIG. 2 is a center section view of one embodiment of the core chuck according to the present invention.

The core chuck 30, FIG. 2, according to the present invention, includes a mounting plate 32, a central cam 34, and an end cap 36. The mounting plate 32 includes a plurality of apertures 38, preferably disposed about the perimeter of the mounting plate 32, sized and shaped to accept a plurality of fasteners 39, typically screws, which are used to secure the mounting plate 32 to a rotating surface 37.

Figure 3:
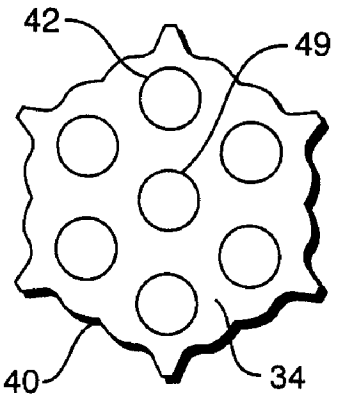
FIG. 3 is an end view of the central cam shown in FIG. 2 according to one embodiment of the present invention.

The central cam 34, FIG. 3, includes a multi faceted exterior or camming surface 40 designed to expand/retract a plurality of jaws 48, FIG. 2, which apply controlled force against the inside of a roll of material, typically lined with a tubular member known as a core (not shown) as is well known in the art. The central cam 34 also includes one or more apertures 42 disposed longitudinally through the central cam 34 which are adapted to receive one or more screws 44 which engage one or more openings 46 within the mounting plate 32, and thus secure the hex 34 to the mounting plate 32. In the preferred embodiment, the core chuck 30 includes six apertures 42 (and corresponding screws 44 and threaded holes 46). As will be discussed in greater detail hereinbelow, the design of the interface 65, FIG. 2, between the central cam 34 and the mounting plate 32 allows the core chuck 30 to have as few as one aperture 42, FIG. 3, screw 44, and opening 46 (e.g., a single screw 58 disposed through the center of the core chuck 30) without any lose of structural integrity or adverse effects on service life. In fact, having only a single aperture 42 may increase the capacity of the core chuck 30.

Figure 1:
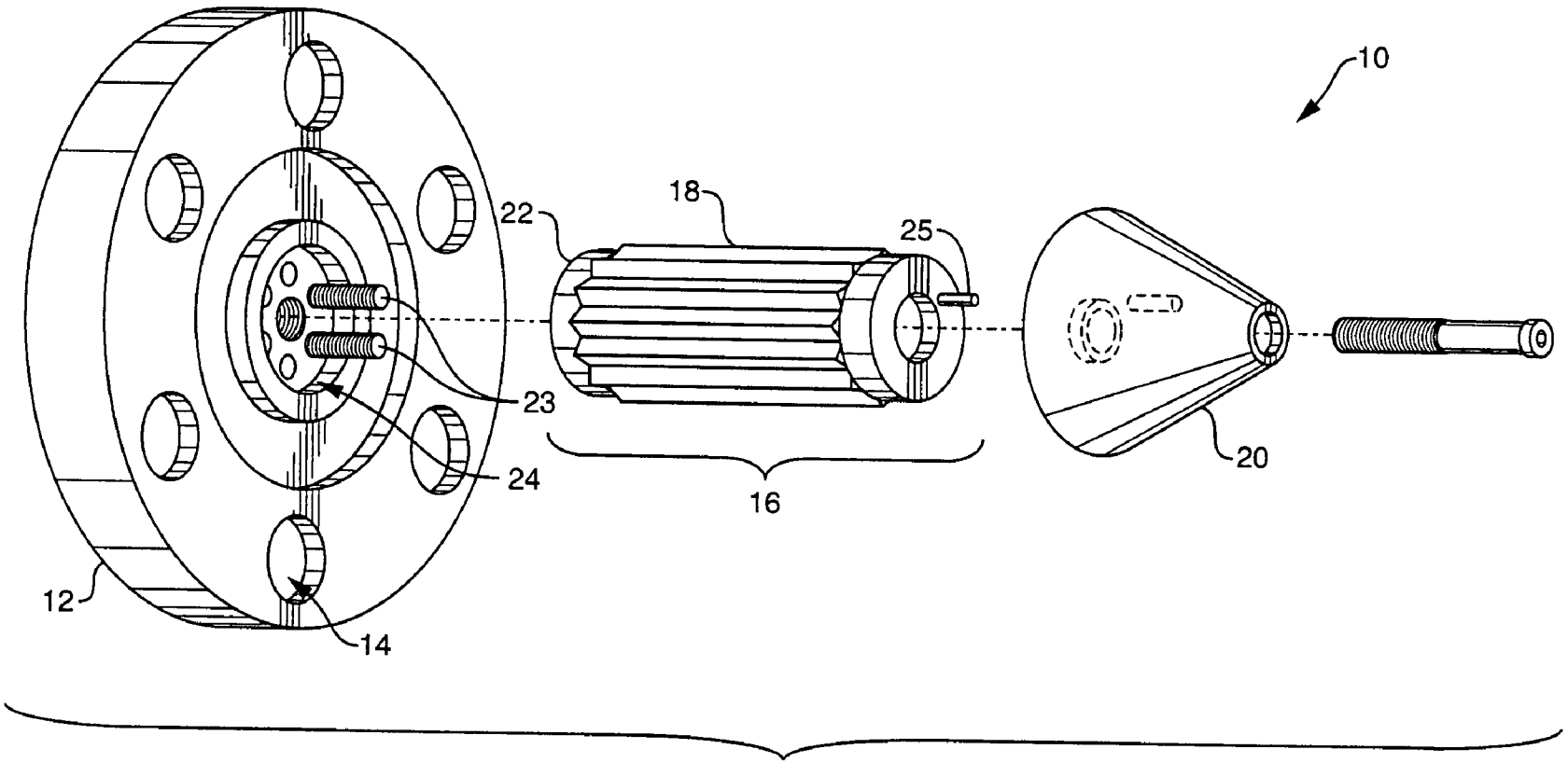
FIG. 1 (PRIOR ART)
FIG. 1 is a perspective view of the central structure of a typical core chuck.
Figure 5:
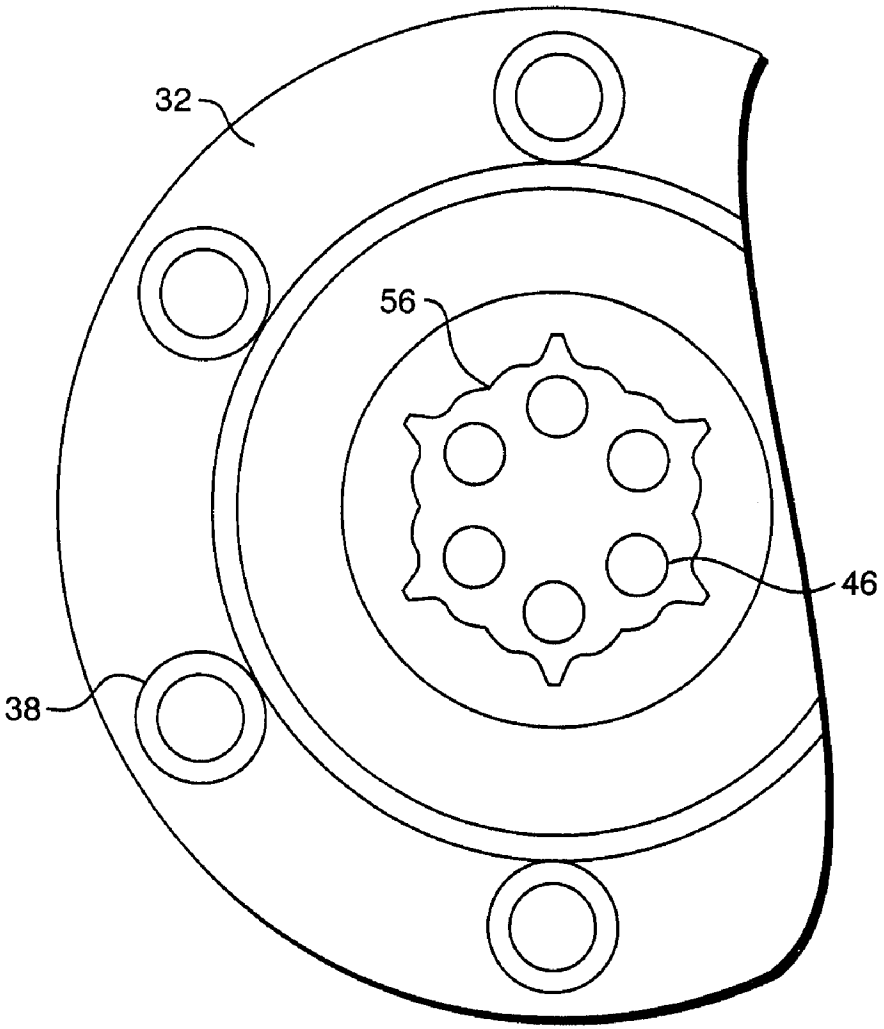
FIG. 5 is an end view of the mounting plate shown in FIG. 2 according to one embodiment of the present invention.
Figure 4:
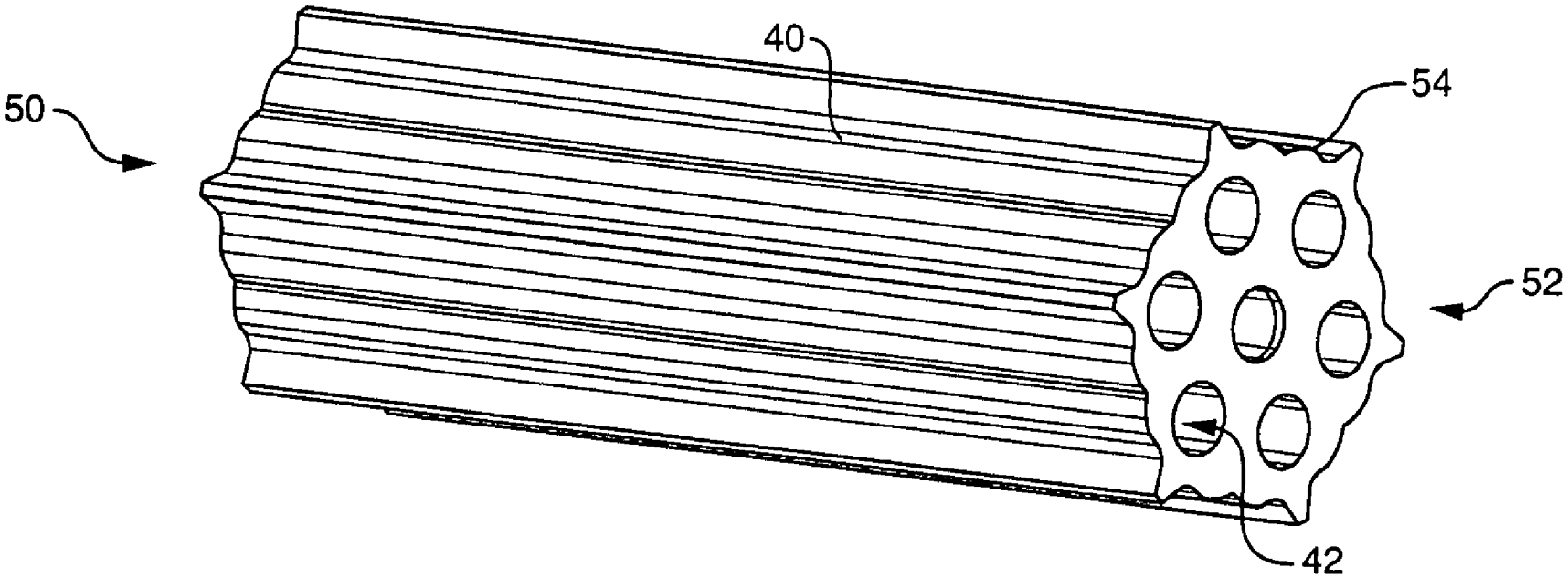
FIG. 4 is a perspective view of the central cam shown in FIG. 3 according to one embodiment of the present invention.

Unlike the known core chucks 10, FIG. 1, which have one end 22 that is turned-down and made cylindrical, the first end 52, FIG. 4, of the central cam 34 according to the present invention has a perimeter 54 having substantially, preferably exactly, the same multi-faceted surface contour as the multi-faceted surface 40, that is, the first end 52 is not made cylindrical. The mounting plate 32, FIG. 5, includes an aperture 56 having a corresponding shape adapted to receive the first end 52 of the central cam 34 such that the interface 65 between the first end 52 and the aperture 56 forms a "lock and key" or "key and keyhole" type arrangement. The perimeter of the aperture 56 engages the perimeter 54 of the central cam 34, thus preventing the central cam 34 from rotating relative to the mounting plate 32. As a result, the shear load and torque are transmitted through the interface 65 by the perimeter 54 of the central cam 34 directly to the perimeter of the aperture 56 of mounting plate 32, and not solely through screws 44. This increases the capacity of the core chuck 30 and thus tends to increase the safety and/or the service life of the core chuck 30.

The interface 65 between the central cam 34 and the mounting plate 32 also allows the core chuck 30 to have only a single, central screw 58. According to one embodiment, the central cam 34 is secured to the mounting plate 32 using a single screw 58 disposed through an aperture 62, FIGS. 6–8, in the end cap 36, the aperture 49, FIG. 3, in the central cam 34, and into aperture 46 (relocated to center), FIG. 5, in the mounting plate 32, such that the single screw fastens all three central members (end cap 36, central cam 34, and mounting plate 32). Design variations of the current invention might alternatively use a central screw to connect the central cam 34 to the mounting plate 32, but fasten the end cap 36 separately.

The second end 50, FIG. 2, of the central cam 34 is adapted to receive end cap 36 using one or more features as is well known in the art. The end cap 20, FIG. 1, according to the known core chucks, includes one or more commercial pins 25 which prevent the cap 20 from rotating relative to the central cam 16.

Figure 8:
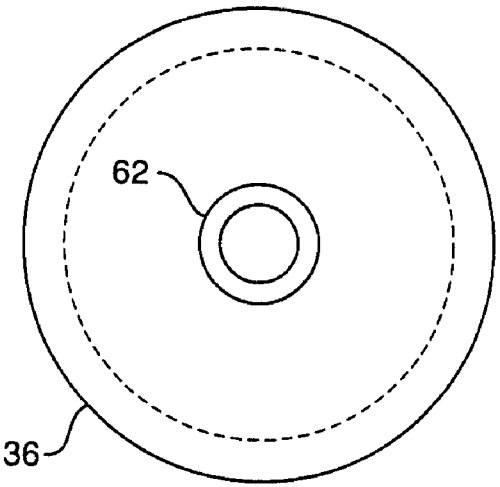
FIG. 8 is an end view (top) of the end cap shown in FIG. 2 according to one embodiment of the present invention.
Figure 7:
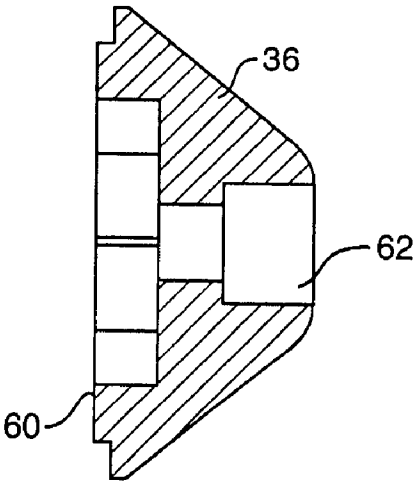
FIG. 7 is a center section view of the end cap shown in FIG. 2 according to one embodiment of the present invention.
Figure 6:
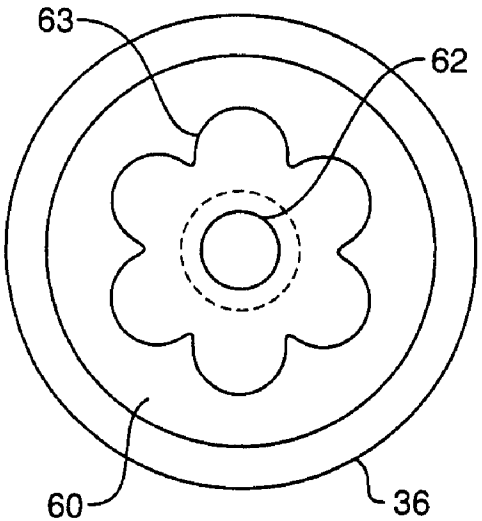
FIG. 6 is an end view (bottom) of the end cap shown in FIG. 2 according to one embodiment of the present invention.

In the preferred embodiment of the present invention, the end cap 36, FIGS. 6–8, includes a first or inner end surface 60 having an inner contour/shape or perimeter 63 sized and shaped to accept the modified heads of screws 44 which secure the central cam 34 to the mounting plate 32. The contour 63 of surface 60 engages the heads of the screws 44 and prevents the end cap 36 from rotating relative to the central cam 34 and thus eliminates the need for commercial pin(s) 25 (FIG. 1). Further, the controlled engagement between the end cap 36 contour 63 and the screws 44 also centers the end cap 36 on the central cam 34, thus precluding the need for cylindrical pilot engagement, as is common in known core chucks. The exact contour 63 of the surface 60 will, of course, depend on the number, size and placement of the screws 44.

Modifications and substitutions by one of ordinary skill in the art are considered to be within the scope of the present invention, which is not to be limited except by the following claims.

The invention claimed is:

1. A core chuck comprising:

a central cam having a first end region, a second end region, and a central region disposed between said first and said second end regions, said central region having a multi-faceted camming surface adapted to expand and retract a plurality of jaws, wherein said first end region includes a multi-faceted perimeter; and a mounting plate having a first aperture sized and shaped to accept at least a portion of said first end region of said central cam such that at an interface between said first aperture and said multi-faceted perimeter of said first end region of said central cam, said aperture and said multi-faceted perimeter have substantially the same shape.

2. The core chuck as claimed in claim 1 wherein said multi-faceted perimeter of said first end region includes a shape substantially corresponding to said multi-faceted camming surface of said central region.

3. The core chuck as claimed in claim 1 wherein said central can includes at least one longitudinally disposed aperture sized and shaped to accept at least one fastener to secure said central cam to said mounting plate.

4. The core chuck as claimed in claim 3 wherein said central cam includes only one longitudinally disposed aperture adapted to secure said central cam to said mounting plate.

5. The core chuck as claimed in claim 1 wherein said mounting plate is adapted to be secured to a support surface.

6. The core chuck as claimed in claim 1 further including an end cap adapted to be secured to said second end region of said central cam.

7. The core chuck as claimed in claim 6 wherein said end cap is secured to said second end region of said central cam without a pin.

8. The core chuck as claimed in claim 6 wherein said central cam includes a plurality of longitudinally disposed apertures sized and shaped to accept a plurality of fasteners, each having a head, for securing said central cam to said mounting plate, disposed proximate said second end region of said central cam, wherein said end cap includes an interior end surface defining an aperture sized and shaped to engage at least a portion of said heads of said fasteners.

9. A core chuck comprising:

a central cam having:

a first and a second end region each defining a non-circular perimeter; and a central region disposed between said first and said second end regions, said central region having a multi-faceted camming surface adapted to expand and retract a plurality of jaws; and a mounting plate defining a cavity having a perimeter sized and shaped such that at an interface between said cavity and said first end region of said central cam, said perimeter of said cavity has substantially the same shape as said non-circular perimeter of said first end region of said central cam.

10. The core chuck as claimed in claim 9 wherein said non-circular perimeter of said first end region includes a shape substantially corresponding to said multi-faceted camming surface of said central region.

11. The core chuck as claimed in claim 9 wherein said central cam includes at least one longitudinally disposed aperture sized and shaped to accept at least one fastener to secure said central cam to said mounting plate.

12. The core chuck as claimed in claim 11 wherein said central cam includes only one longitudinally disposed aperture adapted to secure said central cam to said mounting plate.

13. The core chuck as claimed in claim 9 wherein said mounting plate is adapted to be secured to a support surface.

14. The core chuck as claimed in claim 9 further including an end cap adapted to be secured to said second end region of said central cam.

15. The core chuck as claimed in claim 14 wherein said end cap is secured to said second end region of said central cam without a pin.

16. The core chuck as claimed in claim 14 wherein said central cam includes a plurality of longitudinally disposed apertures sized and shaped to accept a plurality of fasteners, each having a head, disposed proximate said second end region of said central cam and adapted to secure said central cain to said mounting plate, wherein said end cap includes an interior end surface defining a second cavity sized and shaped to engage at least a portion of said heads of said fasteners.

17. A core chuck comprising:

at least one fastener;

a central cam having:

a first and a second end region each defining a non-circular perimeter;

a central region disposed between said first and said second end regions, said central region having a multi-faceted camming surface adapted to expand and retract a plurality of jaws; and at least one longitudinally disposed aperture adapted to receive said at least one fastener;

a mounting plate including a cavity having a size and a shape that is substantially a mirror image of said non-circular perimeter of said first end region of said central cain, said cavity further including at least one aperture adapted to receive said at least one fastener; and an end cap adapted to be secured to said second end region of said central cam.

18. The core chuck as claimed in claim 17 wherein said non-circular perimeter of said first end region includes a shape substantially corresponding to said multi-faceted camming surface of said central region.

19. The core chuck as claimed in claim 17 wherein said end cap is secured to said second end region of said central cam without a pin.

20. The core chuck as claimed in claim 19 wherein said at least one fastener includes a plurality of fasteners each having a head disposed proximate said second end region of said central cam, wherein said end cap includes an interior end surface defining a second cavity sized and shaped to engage at least a portion of said heads of said fasteners.

* * * * *